US008926140B2

(12) United States Patent
Wheelock

(10) Patent No.: US 8,926,140 B2
(45) **Date of Patent: *Jan. 6, 2015**

(54) PARTITIONED HEATSINK FOR IMPROVED COOLING OF AN LED BULB

(75) Inventor: Glenn Wheelock, San Jose, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/543,713

(22) Filed: Jul. 6, 2012

(65) Prior Publication Data

US 2013/0176744 A1 Jul. 11, 2013

Related U.S. Application Data

(63) Continuation-in-part of application No. 13/068,867, filed on Jul. 8, 2011.

(51) Int. Cl.

| | |
|---|---|
| ***F21V 29/00*** | (2006.01) |
| ***F21V 19/00*** | (2006.01) |
| ***F21K 99/00*** | (2010.01) |
| *F21V 3/00* | (2006.01) |
| *F21Y 101/02* | (2006.01) |

(52) U.S. Cl.

CPC ..... *F21V 29/2206* (2013.01); *F21V 19/001* (2013.01); *F21V 29/262* (2013.01); *F21K 9/1355* (2013.01); *F21V 3/00* (2013.01); *F21Y 2101/02* (2013.01)

USPC ..... 362/294; 362/249.02; 362/373

(58) Field of Classification Search

USPC ..... 362/294, 373, 249.02

See application file for complete search history.

(56) References Cited

U.S. PATENT DOCUMENTS

| | | | | |
|---|---|---|---|---|
| 6,999,312 | B1 | 2/2006 | Garnett et al. | |
| 7,581,856 | B2 | 9/2009 | Kang et al. | |
| 7,824,075 | B2 | 11/2010 | Maxik | |
| 8,038,329 | B2 * | 10/2011 | Takahasi et al. | 362/373 |
| 8,083,383 | B2 * | 12/2011 | Chen | 362/373 |
| 8,272,766 | B2 | 9/2012 | Phipps et al. | |
| 8,274,241 | B2 * | 9/2012 | Guest et al. | 315/294 |
| 8,282,250 | B1 * | 10/2012 | Dassanayake et al. | 362/373 |
| 8,354,780 | B2 * | 1/2013 | Luo | 313/45 |
| 8,476,812 | B2 | 7/2013 | Chan et al. | |
| 8,591,063 | B2 | 11/2013 | Yoneda | |

(Continued)

FOREIGN PATENT DOCUMENTS

| | | | |
|---|---|---|---|
| JP | 2008204671 | * | 4/2008 |
| JP | 2008293753 | * | 4/2008 |

OTHER PUBLICATIONS

International Search Report and Written Opinion received for PCT Patent Application No. PCT/US2012/045849, mailed on Oct. 1, 2012, 7 pages.

(Continued)

*Primary Examiner* — Peggy Neils

(74) *Attorney, Agent, or Firm* — Morrison & Foerster LLP

(57) ABSTRACT

A light-emitting diode (LED) bulb has a shell. An LED is within the shell. The LED is electrically connected to a driver circuit, which is electrically connected to a base of the LED bulb. The LED bulb also has a heatsink between the shell and base. A thermal break partitions the heatsink into an upper partition adjacent the shell and a lower partition adjacent the base.

23 Claims, 7 Drawing Sheets

(56) References Cited

U.S. PATENT DOCUMENTS

| | | | | |
|---|---|---|---|---|
| 2008/0013316 | A1 | 1/2008 | Chiang | |
| 2009/0046473 | A1 | 2/2009 | Tsai et al. | |
| 2009/0141508 | A1 | 6/2009 | Peng et al. | |
| 2010/0026185 | A1 * | 2/2010 | Betsuda et al. | 315/32 |
| 2010/0096992 | A1 | 4/2010 | Yamamoto et al. | |
| 2010/0149807 | A1 * | 6/2010 | Hu et al. | 362/249.02 |
| 2011/0089830 | A1 * | 4/2011 | Pickard et al. | 315/32 |
| 2012/0146481 | A1 | 6/2012 | Li et al. | |
| 2012/0182737 | A1 * | 7/2012 | Kuenzler et al. | 362/249.02 |
| 2012/0188745 | A1 | 7/2012 | Yoneda | |

OTHER PUBLICATIONS

Non Final Office Action received for U.S. Appl. No. 13/068,867, mailed on Aug. 7, 2013, 9 pages.

International Preliminary Report on Patentability received for PCT Patent Application No. PCT/US2012/045849, mailed on Jan. 23, 2014, 6 pages.

Notice of Allowance received for U.S. Appl. No. 13/068,867, mailed on Jan. 24, 2014, 9 pages.

Non Final Office Action received for U.S. Appl. No. 13/068,867, mailed on Mar. 15, 2013, 7 pages.

* cited by examiner

PARTITIONED HEATSINK FOR IMPROVED COOLING OF AN LED BULB

BACKGROUND

1. Field

The present disclosure relates generally to a heatsink for a light-emitting diode (LED) bulb, and more specifically to a partitioned heatsink for improved cooling of different components of an LED bulb.

2. Description of Related Art

Traditionally, lighting has been generated using fluorescent and incandescent light bulbs. While both types of light bulbs have been reliably used, each suffers from certain drawbacks. For instance, incandescent bulbs tend to be inefficient, using only 2-3% of their power to produce light, while the remaining 97-98% of their power is lost as heat. Fluorescent bulbs, while more efficient than incandescent bulbs, do not produce the same warm light as that generated by incandescent bulbs. Additionally, there are health and environmental concerns regarding the mercury contained in fluorescent bulbs.

Thus, an alternative light source is desired. One such alternative is a bulb utilizing an LED. An LED comprises a semiconductor junction that emits light due to an electrical current flowing through the junction. Compared to a traditional incandescent bulb, an LED bulb is capable of producing more light using the same amount of power. Additionally, the operational life of an LED bulb is orders of magnitude longer than that of an incandescent bulb, for example, 10,000-100,000 hours as opposed to 1,000-2,000 hours.

The lifetime and performance of an LED bulb depends, in part, on its operating temperature. The lifetime of the LED bulb driver circuit may limit the overall lifetime of the LED bulb if the driver circuit operates at high temperature for long periods of time. Similarly, the lifetime of the LEDs that produce the light may be reduced by excessive heat. Additionally, high operating temperatures can reduce the light output of the LEDs.

While both the driver circuit and LEDs are sensitive to high operating temperatures, these components are also responsible for generating heat. LEDs are about 80% efficient, meaning that 20% of power supplied to LEDs is lost as heat. Similarly, the driver circuit that supplies current to the LED is about 90% efficient, meaning that 10% of the power supplied to it is lost as heat.

The operating temperature of an LED bulb depends on many factors. For example, each individual LED produces heat. Therefore, the number and type of LEDs present in the bulb may affect the amount of heat the LED bulb produces. Additionally, driver circuitry may also produce significant amounts of heat.

Other factors may determine the rate at which generated heat is dissipated. For example, the nature of the enclosure into which the LED bulb is installed may dictate the orientation of the LED bulb, the insulating properties surrounding the LED bulb, and the direction of the convective air stream flowing over the LED bulb. Each of these factors may have a dramatic effect on the buildup of heat in and around the LED bulb.

Accordingly, LED bulbs may require cooling systems that account for the different sources of heat, the ability of components to withstand elevated temperatures, and the variables associated with the dissipation of heat.

BRIEF SUMMARY

One embodiment of an LED bulb has a shell. An LED is within the shell. The LED is electrically connected to a driver circuit, which is electrically connected to a base of the LED bulb. The LED bulb also has a heatsink between the shell and base. A thermal break partitions the heatsink into an upper partition adjacent the shell and a lower partition adjacent the base.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Figure 1:
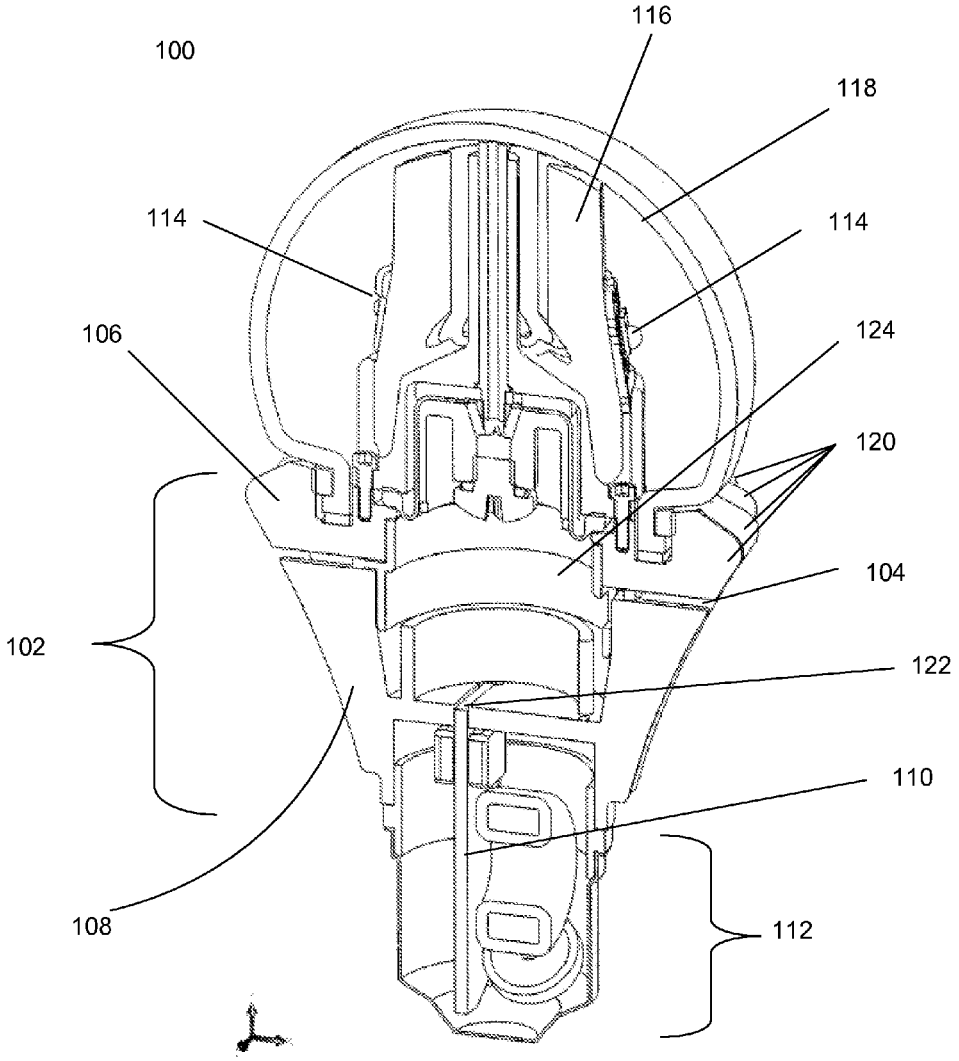
FIG. 1 depicts an exemplary embodiment of an LED bulb with a partitioned heatsink.

FIG. 1 depicts an exemplary embodiment of LED bulb 100 using partitioned heatsink 102 for improved cooling. Thermal break 104 partitions heatsink 102 into upper heatsink partition 106 and lower heatsink partition 108. The amount of heat that may be dissipated by each partition depends, in part, on the amount of surface area that is exposed away from the bulb. The more surface area exposed to the environment outside of the LED bulb, the more heat that may be dissipated.

Heatsink 102 may be made of any materials that exhibit suitable thermal conductivity. For example, metals such as aluminum or copper are often used for heatsink applications. In this exemplary embodiment, a plurality of fins 120 increases the surface area of the heatsink and helps dissipate heat generated by LED bulb 100 into the surrounding environment. Heatsink 102 may be shaped to make LED bulb 100 resemble a common A19 bulb form factor.

Thermal break 104 may be made by cutting or otherwise removing a portion of heatsink 102 to create a void. Alternatively, heatsink 102 may be fabricated, using metal casting or other suitable manufacturing processes, with thermal break 104 in place.

Thermal break 104 may be maintained with a thermally insulting material that completely or partially fills thermal break 104. For example, as depicted in FIG. 1, thermal break 104 may be maintained by connector piece 124 between upper partition 106 and lower partition 108. Connector piece 124 holds upper partition 106 in proper alignment with lower partition 108 while maintaining thermal break 104 as a void. Depending on how connector piece 124 is shaped, connector piece 124 may form part or all of thermal break 104. Suitable materials for connector piece 124 include glass-filled nylon, ceramics, ceramic derivatives, and materials with low thermal conductivity. As an alternative to thermal break 104 being a void, a thermally insulting material may maintain thermal break 104 by partially or completely filling thermal break 104 using injection molding or other suitable manufacturing processes.

Figure 2:
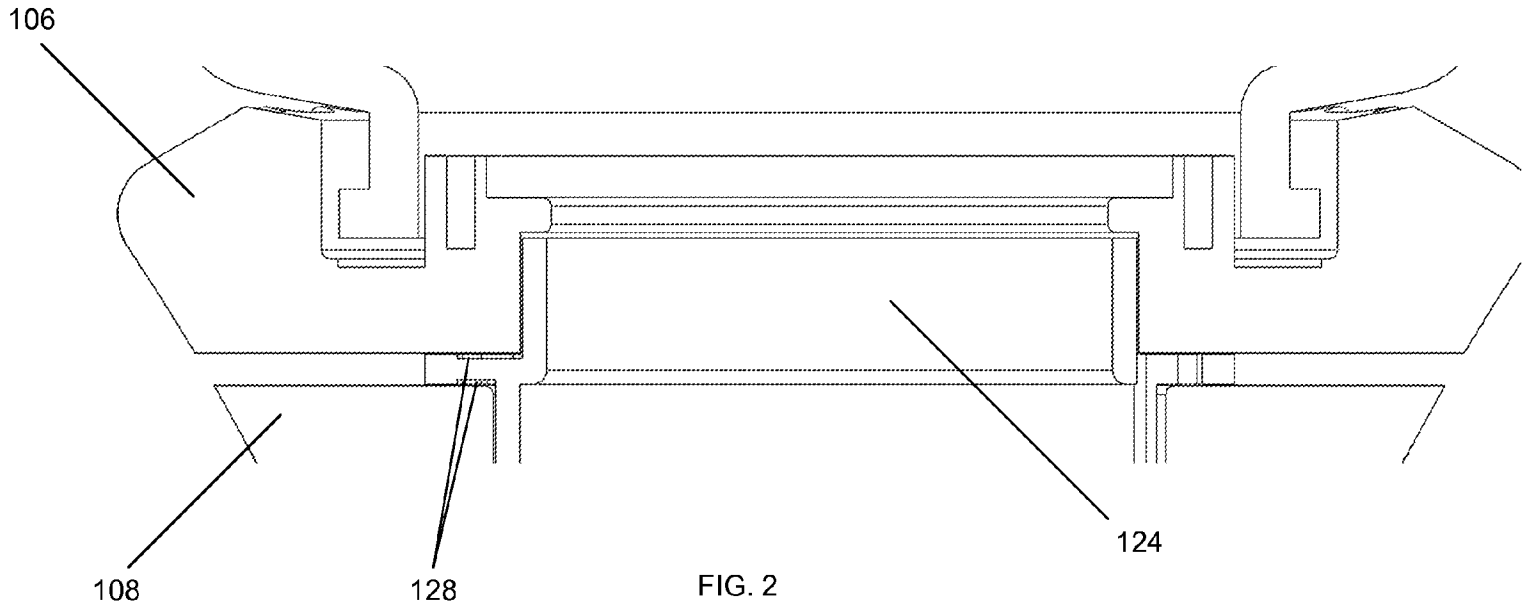
FIG. 2 depicts an enlarged view of a portion of the exemplary embodiment of FIG. 1.
Figure 3:
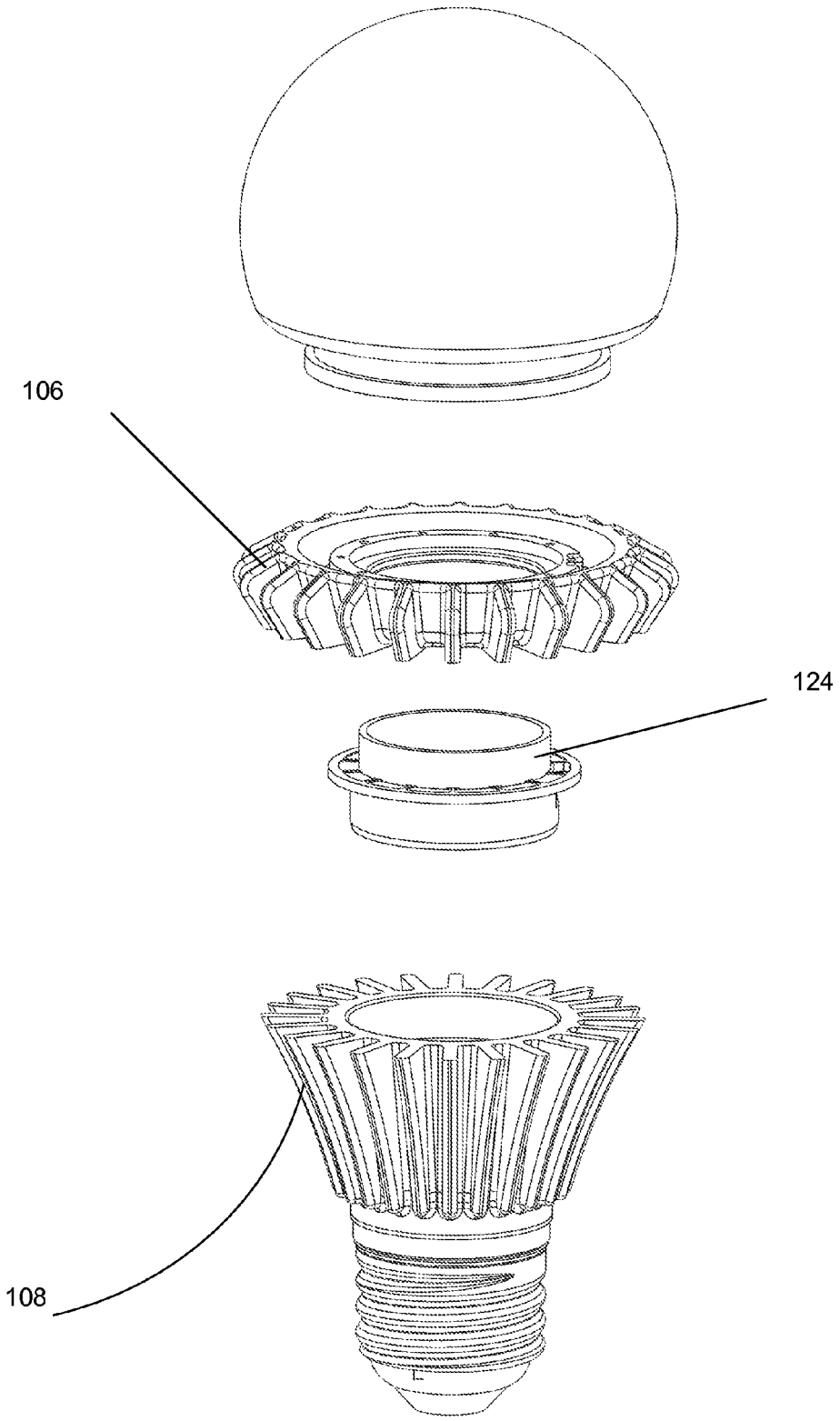
FIG. 3 depicts an exploded view of the exemplary embodiment of FIG. 1.

FIG. 2 depicts a portion of LED bulb 100 (FIG. 1). FIG. 3 depicts an exploded view of LED bulb 100. FIGS. 2 and 3 depict connector piece 124. As depicted in FIG. 2, in this exemplary embodiment, connector piece 124 has voids that define air pockets 128. The use of air pockets 128 may decrease the thermal conductivity between upper partition 106 and lower partition 108. However, in alternative embodiments, LED bulb 100 (FIG. 1) can also use connector pieces without voids or air pockets.

Referring back to FIG. 1, the location of thermal break 104 may be selected to allocate portions of heatsink 102 between driver circuit 110 and LEDs 114. The size of the portions allocated to driver circuit 110 and LEDs 114 affects the ability of heatsink 102 to cool those components. Factors that may be considered in allocating the portions of heatsink 102 between driver circuit 110 and LEDs 114 include the amount of heat generated by each component, the sensitivity of each component to elevated temperatures, and other paths that each component may have for dissipating heat.

Driver circuit 110, which is located substantially within bulb base 112, controls the drive current delivered to LEDs 114 that are mounted on LED mounts 116, which are disposed within shell 118. LED mounts 116 may help transfer heat from LEDs 114 to heatsink 102. LED mounts 116 may be formed as part of heatsink 102. Alternatively, LED mounts 116 may be formed separate from heatsink 102, but are still thermally coupled to heatsink 102. As another alternative, LED mounts 116 may be omitted, and the LEDs 114 may be mounted to heatsink 102 to thermally couple LEDs 114 to upper partition 106.

Thermal vias or a metal core printed circuit board (PCB) may facilitate heat transfer from drive circuit 110 to heatsink 102 at position 122. For example, in this exemplary embodiment, driver circuit 110 may produce less heat than LEDs 114, but driver circuit 110 may also be more sensitive to high temperatures. Specifically, driver circuit 110 may be able to operate in temperatures up to 90° C. without damage, but LEDs 114 may be able to operate in temperatures up to 120° C. without damage. Additionally, LEDs 114 may be able to dissipate some heat out of shell 118, especially if shell 118 is filled with a thermally conductive liquid. Therefore, in this exemplary embodiment, thermal break 104 is placed to allocate the majority of heatsink 102 in the form of lower heatsink partition 108 to cooling driver circuit 110. The rest of heatsink 102 is allocated to cooling LEDs 114 in the form of upper heatsink partition 106.

In addition to allocating partitions of heatsink 102 to driver circuit 110 and LEDs 114, thermal break 104 may also prevent heat from LEDs 114 from affecting driver circuit 110. Without thermal break 104, heat from LEDs 114 may degrade or damage driver circuit 110 because LEDs 114 typically produce more heat than driver circuit 110, and driver circuit 110 is typically more sensitive to heat than LEDs 114.

Figure 4:
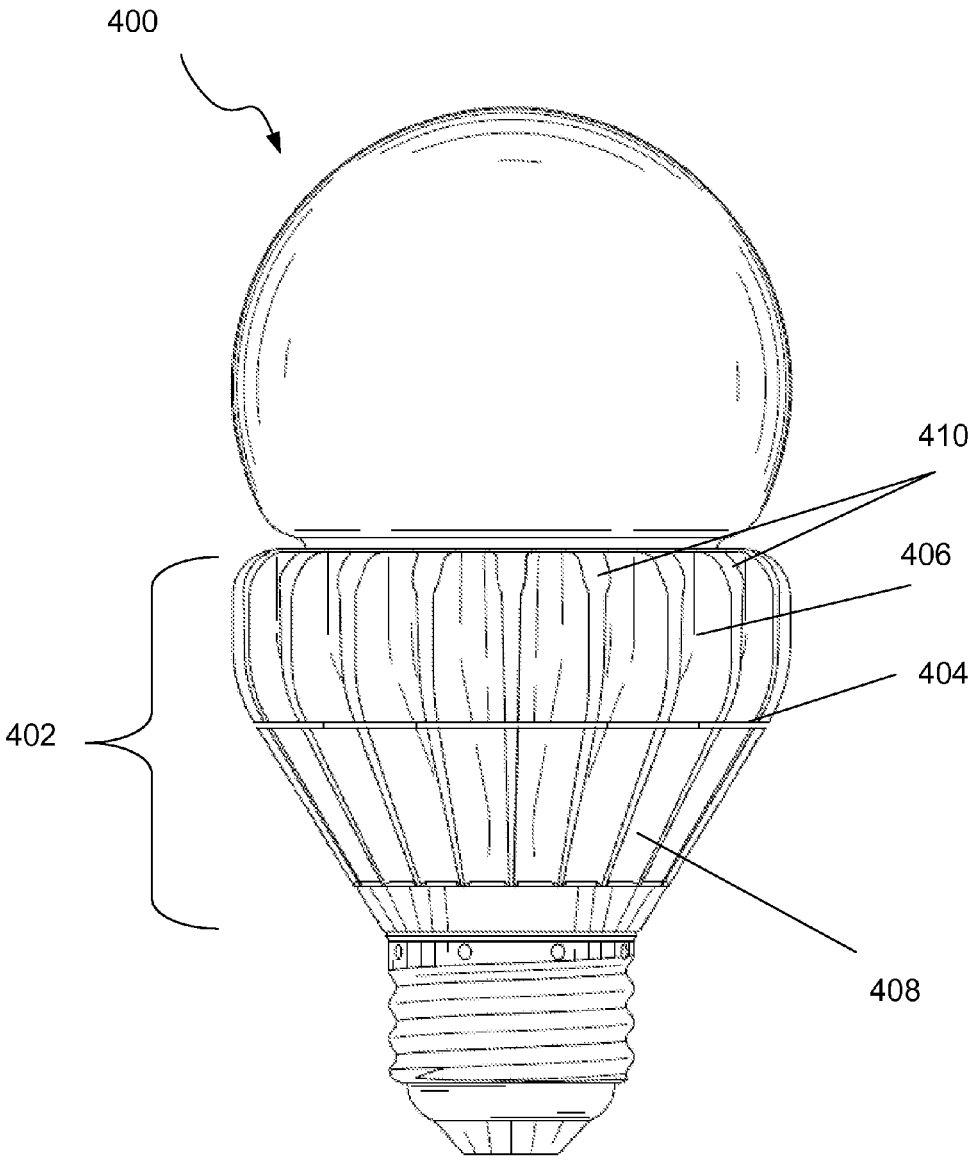
FIG. 4 depicts another exemplary embodiment of an LED bulb with a partitioned heatsink.

FIG. 4 depicts another exemplary embodiment of LED bulb 400 using partitioned heatsink 402 for improved cooling. Thermal break 404 partitions heatsink 402 into upper partition 406 and lower partition 408. In this exemplary embodiment, a plurality of fins 410 increases the surface area of heatsink 402 and helps dissipate heat generated by LED bulb 400 into the surrounding environment.

Figure 5:
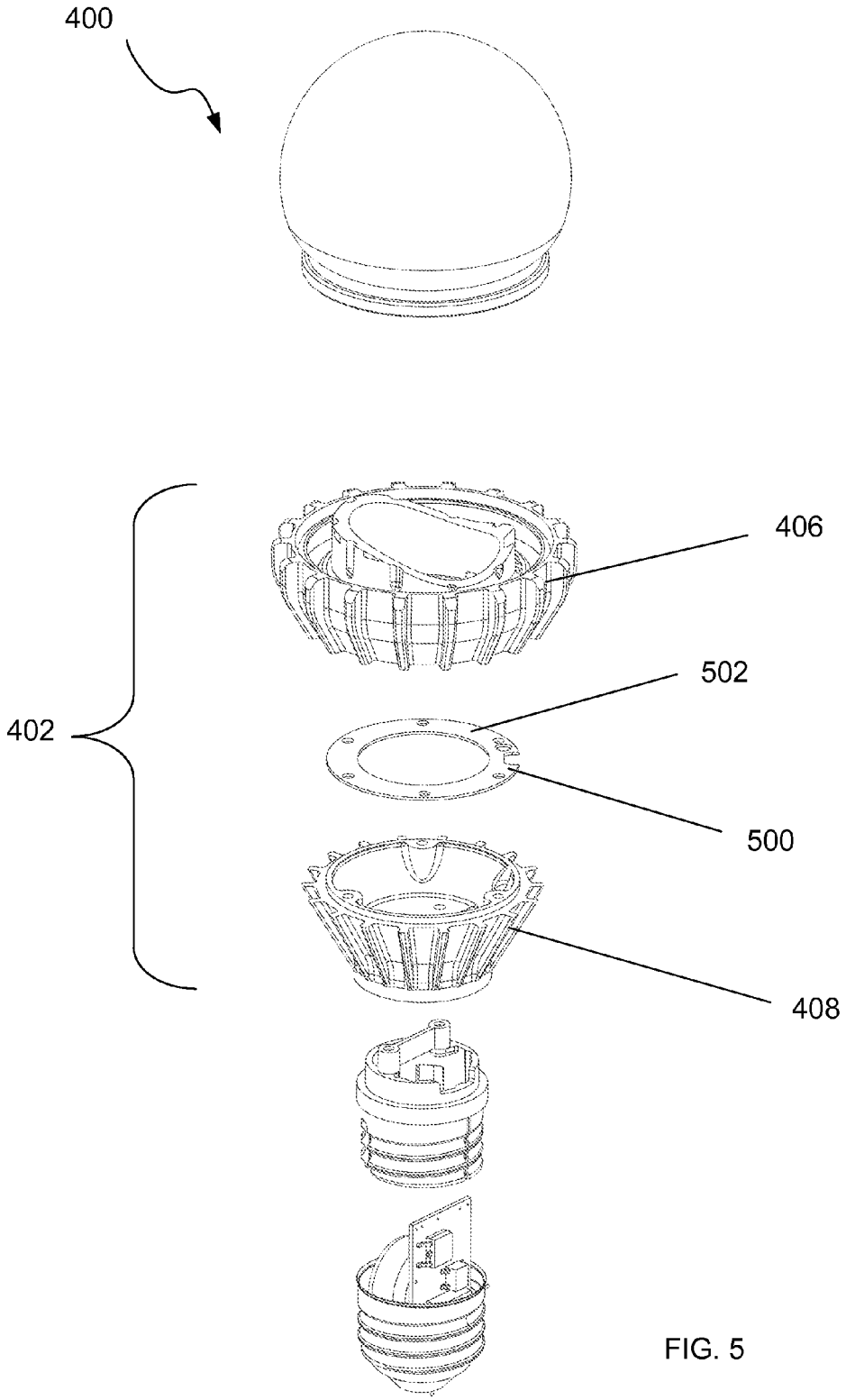
FIG. 5 depicts an exploded view of the exemplary embodiment of FIG. 4.

FIG. 5 depicts an exploded view of LED bulb 400. In this exemplary embodiment, thermal break 404 (FIG. 4) is implemented with connector piece 500. As shown in FIG. 5, in this exemplary embodiment, connector piece 500 has holes 502 in the disk-shaped portion that separates upper partition 406 and lower partition 408. The use of holes 502 may decrease the thermal conductivity between upper partition 406 and lower partition 408.

As compared to heatsink 102 (FIG. 1) of LED bulb 100 (FIG. 1), heatsink 402 of LED bulb 400 is partitioned so that upper partition 406 is a greater proportion, meaning effective heatsinking capacity, of heatsink 402 as compared to the proportion that upper partition 106 (FIG. 1) uses of heatsink 102 (FIG. 1). For example, upper partition 406 can be configured to have more mass and/or exposed surface area than upper partition 106 (FIG. 1). By dedicating more of heatsink 402 to upper partition 406, heatsink 402 may be able to dissipate more heat generated by the LEDs of LED bulb 400 as compared to the ability of heatsink 102 (FIG. 1) to dissipate heat generated by LEDs 114 (FIG. 1).

Figure 6:
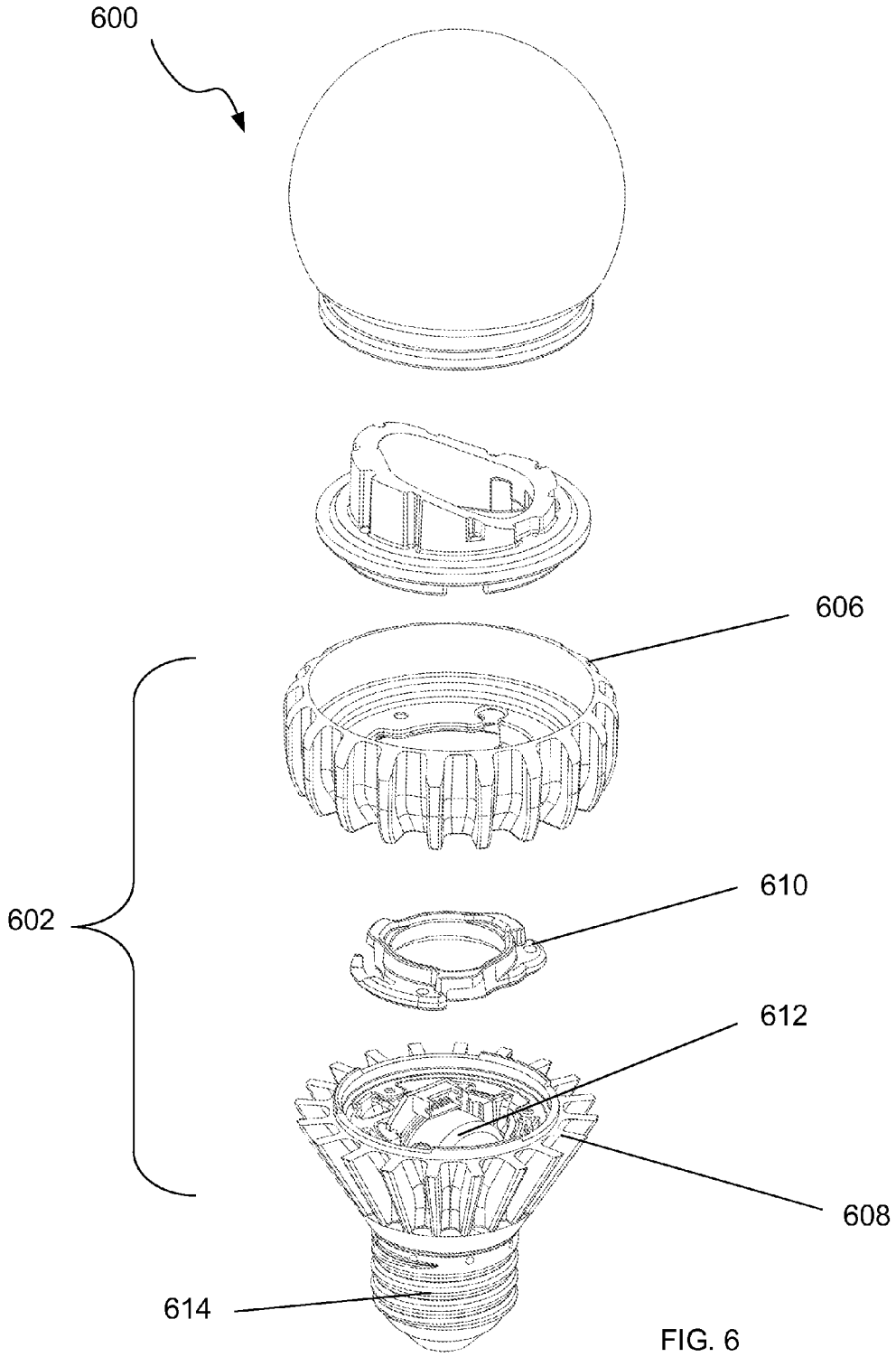
FIG. 6 depicts an exploded view of yet another exemplary embodiment of an LED bulb.

FIG. 6 depicts yet another exemplary embodiment of LED bulb 600 using partitioned heatsink 602 for improved cooling. A thermal break partitions heatsink 602 into upper partition 606 and lower partition 608. The amount of heat that may be dissipated by each partition depends, in part, on the amount of exposed surface area. The more surface area exposed to the environment outside of LED bulb 600, the more heat that may be dissipated. In this exemplary embodiment, the thermal break is implemented with connector piece 610. LED bulb 600 includes driver circuit 612 within lower partition 608 and base 614.

Figure 7:
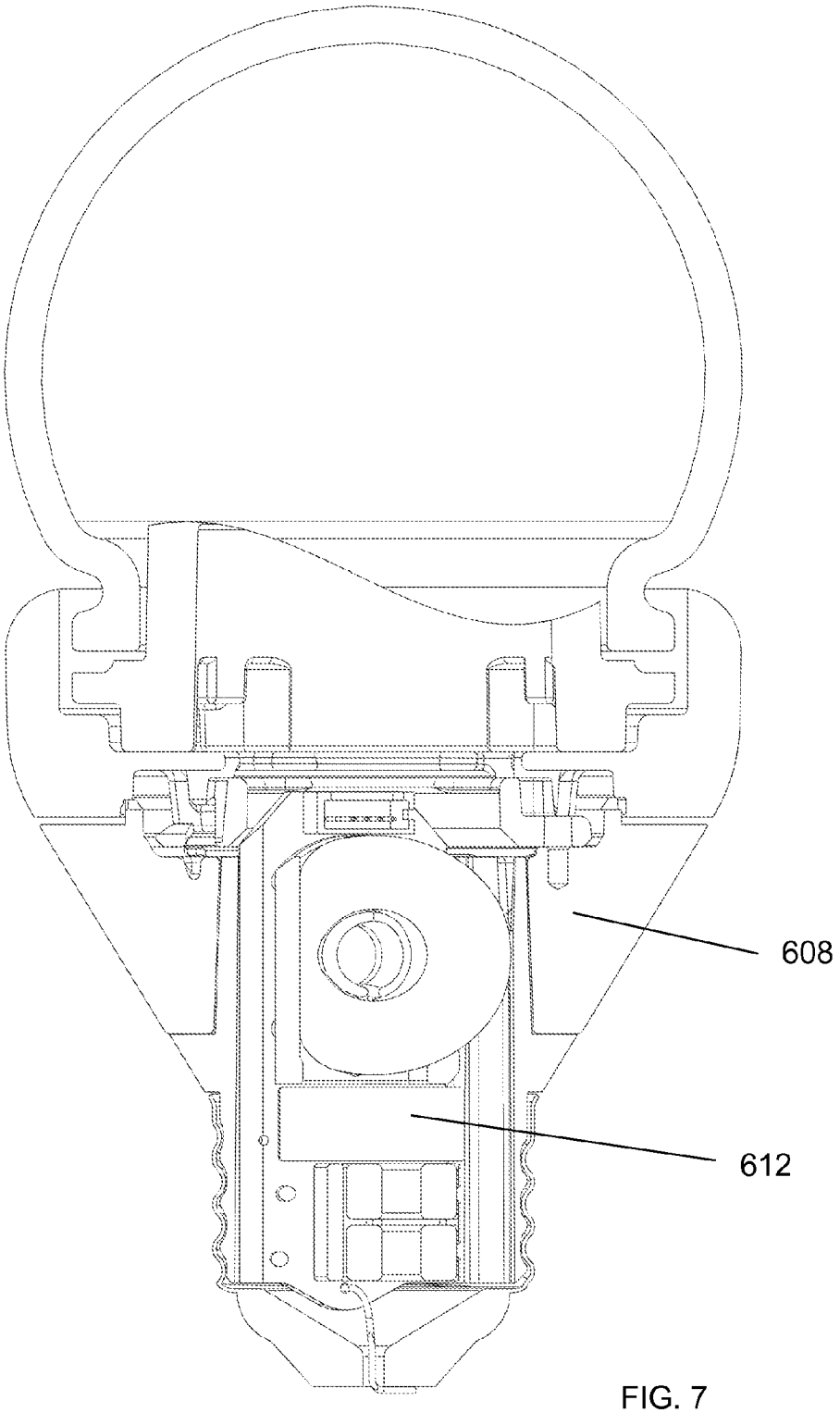
FIG. 7 depicts a cross-sectional view of the exemplary embodiment of FIG. 6.

FIG. 7 depicts a cross-section of LED bulb 600. As shown in FIG. 7, lower partition 608 substantially surrounds driver circuit 612. This may allow for better heat transfer from driver circuit 612 to lower partition 608, which may allow driver circuit 612 to operate at a cooler temperature.

Although a feature may appear to be described in connection with a particular embodiment, one skilled in the art would recognize that various features of the described embodiments may be combined. Moreover, aspects described in connection with an embodiment may stand alone.

What is claimed is:

1. A light-emitting diode (LED) bulb comprising:
a shell;
an LED within the shell;
a driver circuit electrically connected to the LED;
a base electrically connected to the LED driver circuit; and
a heatsink between the base and the shell, wherein the heatsink has a plurality of fins disposed around an outward-facing surface of the heatsink and a thermal break defining an upper partition adjacent the shell and a lower partition adjacent the base, and wherein the upper partition and the lower partition each conducts heat through the body of the respective partition to dissipate heat from the LED bulb via the plurality of fins.

2. The LED bulb of claim 1, wherein the heatsink is made of aluminum.

3. The LED bulb of claim 1, wherein the upper partition has a smaller exposed surface area than the lower partition.

4. The LED bulb of claim 1, wherein the heatsink is made of a metal having a first thermal conductivity and the thermal break is implemented with a spacer made of a material having a second thermal conductivity that is lower than the first thermal conductivity.

5. The LED bulb of claim 4, wherein the spacer has voids that reduce the thermal conductivity between the upper partition to the lower partition.

6. The LED bulb of claim 1, wherein the driver circuit is thermally coupled to the lower heatsink partition.

7. The LED bulb of claim 1, wherein the LED is thermally coupled to the upper heatsink partition.

8. The LED bulb of claim 1, wherein the LED is mounted on an LED mount, wherein the LED mount is metal, and wherein the LED mount is thermally coupled to the upper partition.

9. The LED bulb of claim 1, wherein the thermal break is a void.

10. The LED bulb of claim 1, wherein the driver circuit is within the lower partition and the base.

11. The LED bulb of claim 1, wherein the shell is filled with a thermally conductive liquid.

12. The LED bulb of claim 1, wherein the thermal break is implemented with a connector piece.

13. The LED bulb of claim 12, wherein the connector piece has holes.

14. The LED bulb of claim 1, wherein the LED is connected to the upper partition, and wherein part of the driver circuit is connected to the lower partition, and wherein the upper partition and lower partition are configured to operate at different temperatures.

15. The LED bulb of claim 14, wherein the upper partition is configured to operate at a higher temperature than the lower partition.

16. The LED bulb of claim 14, further comprising an LED mount, wherein the LED is mounted on the LED mount.

17. The LED bulb of claim 14, further comprising thermal vias or a metal core printed circuit board.

18. A method of making a light-emitting diode (LED) bulb comprising:

electrically connecting a driver circuit to an LED;

electrically connecting the driver circuit to a base of the LED bulb; and placing the LED within a shell of the bulb, wherein a heatsink is disposed between the base and the shell, wherein the heatsink has a plurality of fins disposed around an outward-facing surface of the heatsink and a thermal break defining an upper partition adjacent the shell and a lower partition adjacent the base, and wherein the upper partition and the lower partition each conducts heat through the body of the respective partition to dissipate heat from the LED bulb via the plurality of fins.

19. The method of claim 18, wherein the upper partition has a smaller exposed surface area than the lower partition.

20. The method of claim 18, wherein the heatsink is made of a metal having a first thermal conductivity and the thermal break is implemented with a spacer made of a material having a second thermal conductivity that is lower than the first thermal conductivity.

21. The method of claim 18, further comprising:

thermally coupling the driver circuit to the lower heatsink partition.

22. The method of claim 18, further comprising:

thermally coupling the LED to the upper heatsink partition.

23. The method of claim 18, further comprising:

filling the shell with a thermally conductive liquid.

* * * * *